US012790751B2

(12) United States Patent
Eerikäinen et al.

(10) Patent No.: US 12,790,751 B2
(45) Date of Patent: Nov. 10, 2026

(54) SET FOR MAINTENANCE OF A DOCTOR BLADE IN A FIBER WEB MACHINE AND DOCTOR ARRANGEMENT IN A FIBER WEB MACHINE

(71) Applicant: Valmet Technologies, Inc., Espoo (FI)

(72) Inventors: Hannu Eerikäinen, Varkaus (FI); Tommi Luosma, Jyväskylä (FI); Toni Tikka, Jyväskylä (FI); Pasi Viitasalo, Jyväskylä (FI); Kimmo Kauppinen, Koivula (FI)

(73) Assignee: Valmet Technologies, Inc., Espoo (FI)

( * ) Notice: Subject to any disclaimer, the term of this patent is extended or adjusted under 35 U.S.C. 154(b) by 275 days.

(21) Appl. No.: 18/528,377

(22) Filed: Dec. 4, 2023

(65) Prior Publication Data

US 2024/0191432 A1 Jun. 13, 2024

(30) Foreign Application Priority Data

Dec. 9, 2022 (FI) ..... 20226092

(51) Int. Cl.
*D21G 3/00* (2006.01)
*D21G 9/00* (2006.01)

(52) U.S. Cl.
CPC ..... *D21G 3/005* (2013.01); *D21G 9/00* (2013.01)

(58) Field of Classification Search
CPC ..... D21G 3/005; D21G 9/00
See application file for complete search history.

(56) References Cited

U.S. PATENT DOCUMENTS 3,271,808 A * 9/1966 Bedard ..... D21G 3/005 269/25

FOREIGN PATENT DOCUMENTS

| | | | | |
|---|---|---|---|---|
| DE | 20000827 U1 * | 4/2000 | ..... | D21G 3/005 |
| DE | 10051999 A1 * | 5/2002 | ..... | D21G 3/005 |
| DE | 102008006643 A1 * | 7/2008 | ..... | D21H 23/34 |
| EP | 3111006 B1 | 11/2017 | | |

OTHER PUBLICATIONS

European Search Report for EP23211669 dated Mar. 22, 2024.
Written Opinion of the European Searching Authority for EP23211669 dated Mar. 22, 2024.

* cited by examiner

*Primary Examiner* — Jacob T Minskey
*Assistant Examiner* — Stephen M Russell
(74) *Attorney, Agent, or Firm* — Stiennon & Stiennon

(57) ABSTRACT

A set for maintenance of a doctor blade (10) positioned within a doctor blade holder (11) in a fiber web machine has a portable device (14) for moving the doctor blade (10) out from the doctor blade holder (11). A prolonged doctor blade holder (11) extends outwardly from the doctor blade holder, and a safety cage (15) is positioned in the area of an end of the doctor blade holder (11). The invention also relates to a doctor arrangement for a fiber web machine.

17 Claims, 4 Drawing Sheets

SET FOR MAINTENANCE OF A DOCTOR BLADE IN A FIBER WEB MACHINE AND DOCTOR ARRANGEMENT IN A FIBER WEB MACHINE

CROSS REFERENCES TO RELATED APPLICATIONS

This application claims priority on FI 20226092, filed Dec. 9, 2022, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a set for maintenance of a doctor blade in a fiber web machine, in which fiber web machine a doctor blade is positioned in a blade holder, and the set includes a portable device for moving the doctor blade out from the blade holder. The invention also relates to a doctor arrangement in a fiber web machine.

SUMMARY OF THE INVENTION

EP-patent number 3111006 discloses a device for pulling a doctor blade out of the doctor blade holder in a fiber web machine. The device has feed rollers, which grip the doctor blade and pull out the doctor blade. The device can be used even when the fiber web machine is running.

The known device is big and heavy. In practice, at least two persons are required for handling the device and removing the doctor blade. Also, it is laborious and hazardous to position the device in connection to the doctor blade holder. The rotating machine parts, like rolls and cylinders are close. Also, the pulled-out doctor blade is hard to handle and there is a constant threat of injuries since the used doctor blade has a very sharp edge.

It is an object of the invention to provide for maintenance of a doctor blade in a fiber web machine a novel set which is easier and more safe to use than before. Another object of the invention is to provide a novel doctor arrangement in a fiber web machine which can be maintained during running. The set includes simple and robust, but yet light-weight components. The portable device is easy to handle, and the set is suitable for different, even high positions. The fiber web machine can run even as the doctor blades are changed. This increases the run time of the fiber web machine without weakening the occupational safety.

BRIEF DESCRIPTION OF THE DRAWINGS

The invention is described below in detail by referring to the enclosed drawings which illustrate some of the embodiments of the invention.

DESCRIPTION OF THE PREFERRED EMBODIMENTS

Figure 1:
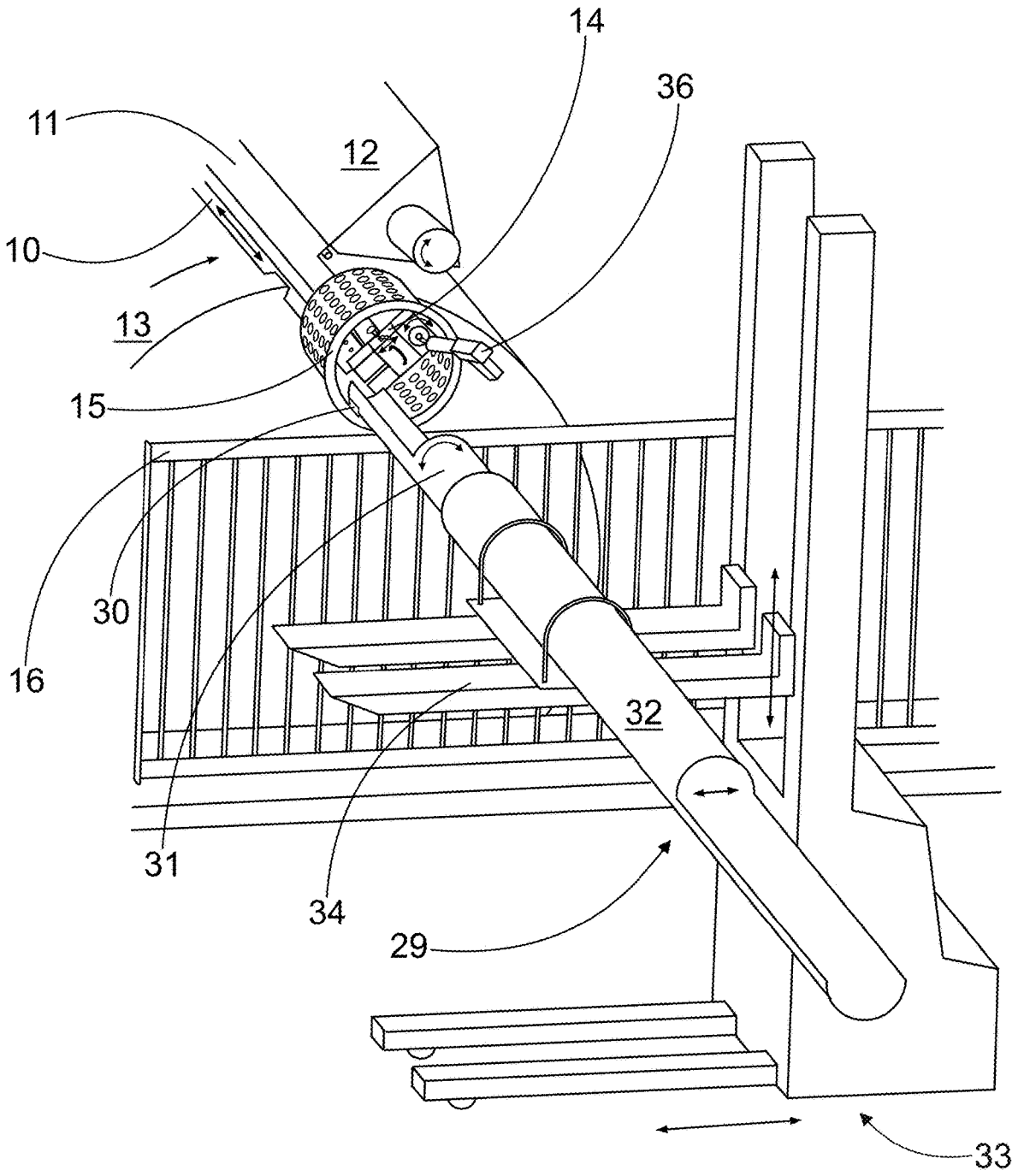
FIG. 1 shows a set according to the invention in connection with a fiber web machine.

FIG. 1 shows a set for maintenance of a doctor blade in a fiber web machine. In the fiber web machine the doctor blade 10 is positioned in a doctor blade holder 11, which is adapted to the vicinity of a surface 13 to be doctored. One fiber web machine such as paper, board, or tissue machine has tens of doctors each including a doctor blade. In FIG. 1, one doctor blade 10 is fixed to a doctor beam 12 via the doctor blade holder 11. Also other kinds of support structures for the doctor blade holder may be used. Here the surface 13 rotates clockwise. The surface can be, for example, the surface of a drying cylinder. Then the doctor blade keeps the surface clean when the drying cylinder rotates, and the doctor blade is in contact with the moving surface.

Normally, the doctor is maintained during the shutdown of the fiber web machine. Then the surface is stationary, i.e., the dryer cylinder is non-rotating. The doctor can be safety reached and the doctor blade can be removed from the doctor blade holder usually by hands and simple hand tools when needed. However, for several reasons, the operators of the fiber web machine are willing to change the doctor blade during production, i.e., when the fiber web machine is running, and the drying cylinders are rotating at high speed. Then it is hazardous or in practice illegal to handle the doctor blade with hands. Partly for this reason the set includes a portable device 14 for moving the doctor blade 10 out from the doctor blade holder 11. The portable device grips to the doctor blade and forces the doctor blade out of the doctor blade holder.

Figure 3:
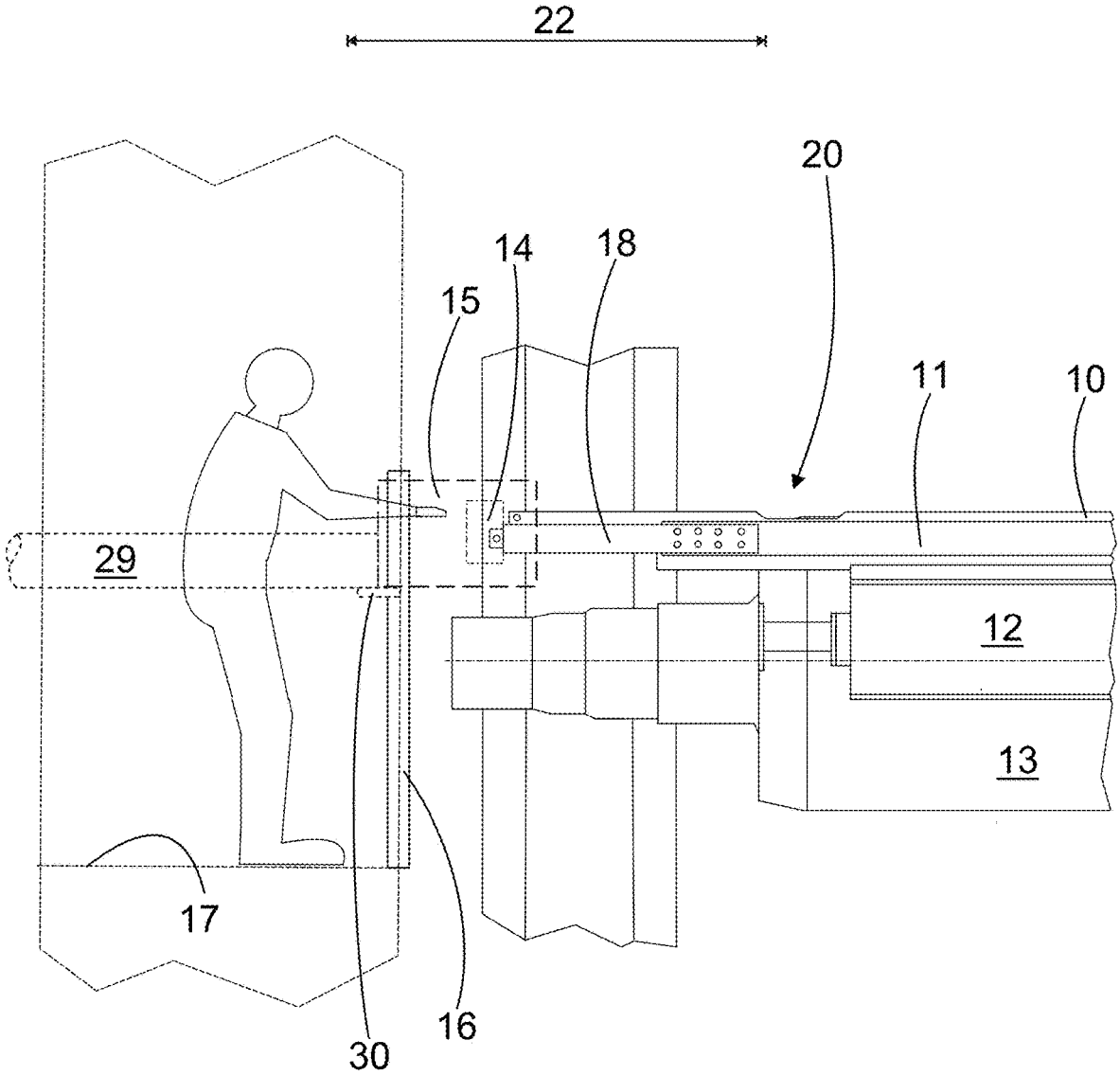
FIG. 3 shows a part of the set according to the invention seen in the machine direction.

In FIG. 1 the complete set according to the invention is in action. First, the set includes a prolonged doctor blade holder 11 and a safety cage 15 to be positioned in the area of the end of the doctor blade holder 11. In this way, there is more distance from the rotating part to the portable device. At the same time, the removed doctor blade is inside the safety cage thereby preventing injuries. Here the safety cage 15 is cylindrical and perforated all around. Thus the safety cage is light-weight and the area of the end of the doctor blade holder can be monitored from different angles. In the bottom of the safety cage there is a slot for the doctor blade holder and the doctor blade. Thus the safety cage surrounds the end of the doctor blade holder but is still loose from the doctor blade holder or doctor blade. The safety cage itself is firmly attached to the fiber web machine, for example, to the safety fence 16 of the walkway 17 (FIGS. 1 and 3). The safety cage can be fixed to the frame of the fiber web machine also.

The portable device 14 can be positioned at least partly inside the safety cage 15. In other words, the safety cage 15 is larger than the portable device 14. The size and shape of the safety cage may vary. In FIGS. 1 and 3 the portable device 14 goes entirely inside the safety cage 15. Thus during installation and operating the portable device is surrounded by the safety cage.

As mentioned earlier, the safety cage 15 is a separate from the doctor blade holder 11. So any vibration from the doctor blade holder to the safety cage is avoided and the safety cage can be fixed firmly, for example in the area of a safety fence 16. On the other hand, the safety cage may be detachable. Then the safety cage will be in place only during the maintenance of the doctor blade.

Figure 2A:
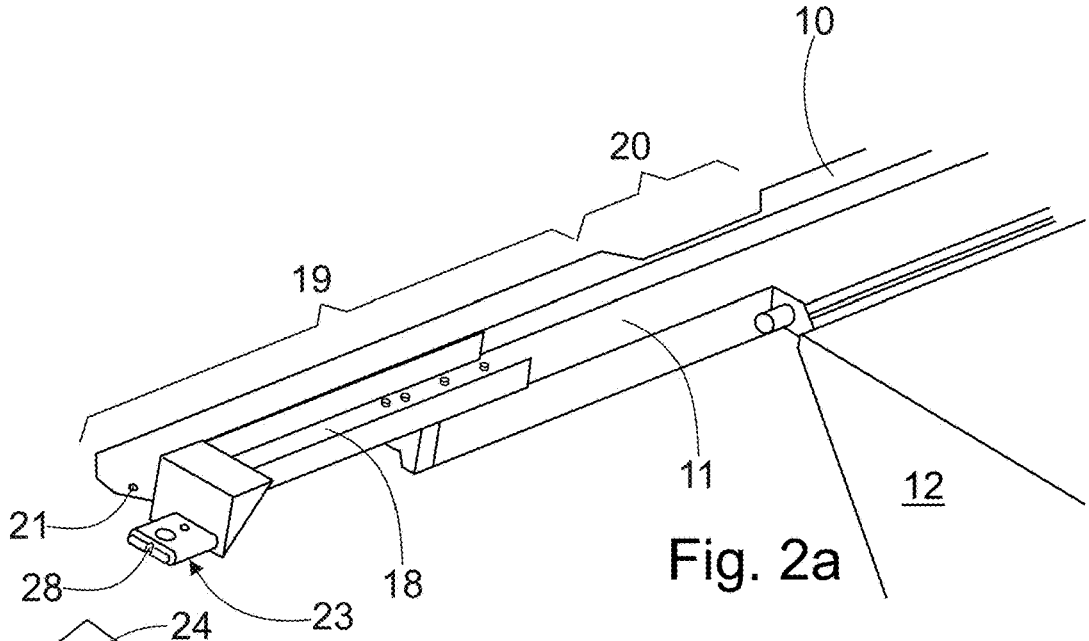
FIG. 2*a* shows a part of the set according to the invention.
Figure 2B:
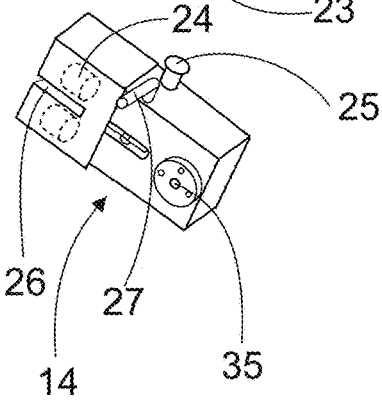
FIG. 2*b* shows the part of FIG. 2*a* with a portable device.
Figure 2B:
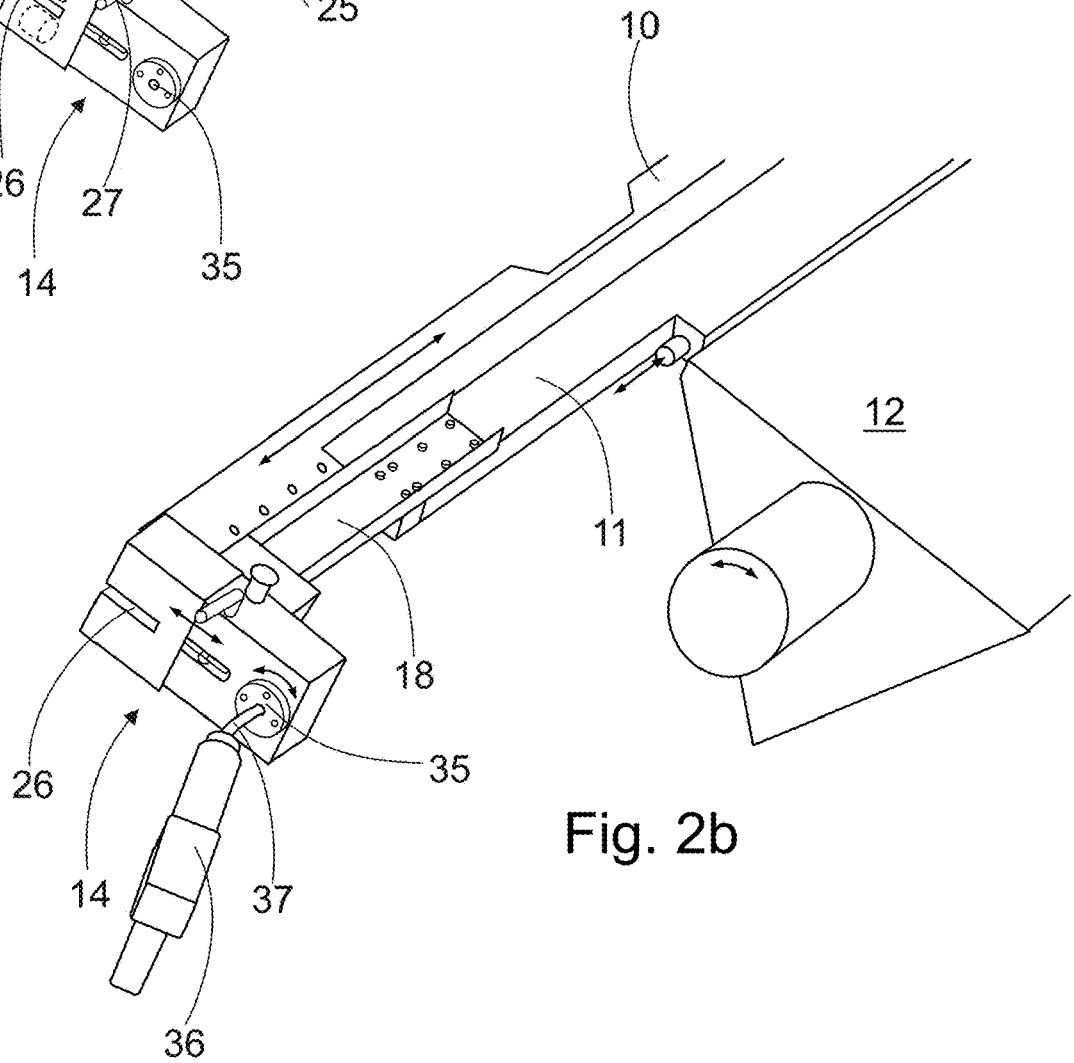

In FIGS. 2*a* and 2*b* the doctor beam 12 is shown only partly. Usually, the doctor has the same dimensions as the doctor beam. In other words, the doctor blade holder ends to the end of the doctor beam in cross-machine direction. However, now the doctor blade holder 11 protrudes further out than the doctor beam 12. Advantageously, the outer end of the prolonged blade holder 11 is formed of an extension piece 18. So, there is first a prolonged doctor blade holder and then there is the extension piece. At the same time, the doctor blade 10 is longer than usual. With these new extensions, the doctor blade can be reached from a safe distance far from the rotating cylinder. The extension piece 18 is a fixed part bolted to the doctor blade holder 11. Other parts of the doctor remain unchanged. So the doctors now in the fiber web machine can be updated simply by installing a prolonged doctor blade and a prolonged doctor blade holder with the extension piece.

The prolonged parts move with the doctor blade holder without disturbing the daily functionality of the doctor. Here, the doctor blade 10 has an outer portion 19 connected with a reduced width segment or narrowing 20 to the rest of the doctor blade 10. Then it is ensured that the doctor blade contours to the surface of the drying cylinder, and the surface is cleaned without uneven blade wear. At the end of the doctor blade 10 there is an aperture 21 for a blade removing tool. Thus the doctor blade is first loosened with a hand tool and the rest of the doctor blade is pulled out with the portable device. Using a hook like tool with a long arm together with the portable device the doctor blade can be handled without physical hand contact of the doctor blade.

In practice, the prolonged blade holder 11 and the safety cage 15 together define a safety distance 22 of 500 mm at minimum. So, the doctor blade 10 can be safely reached from the walkway 17, for example. Simultaneously, the rotating drying cylinder is far enough away. This improves occupational safety significantly.

According to the invention, the outer end of the extension piece 18 includes an attachment point 23 for the portable device 14. In this way, the portable device will always be correctly orientated. In other words, the feed rollers 24 of the portable device will grip the doctor blade and can pull out the doctor blade without floundering (FIG. 2*a*). The portable device is locked to the attachment point 23 with a lock pin 25. So, during operation, the portable device will stay still independently. FIG. 2*b* shows a slot 26 through which the doctor blade goes. The slot 26 is parallel with the doctor blade 10, and the feed rollers 24 are positioned on both sides of the slot 26. Here, the portable device has two working positions, one for pulling out the doctor blade and one for pushing the doctor blade in to the doctor blade holder. In both positions, the portable device urges the doctor blade towards the bottom of the doctor blade holder. In this way the doctor blade will slide smoothly in the doctor blade holder without biting of rivets. The working position is selected by a lever 27, which fits to a nick 28 at the tip of the attachment point 23. By turning the lever 27, the portable device 14 will swing a few degrees.

As shown in FIG. 1, the set further includes a safety tube 29 for surrounding the doctor blade 10 external from the blade holder 11. Thus the removed doctor blade is secured inside the safety tube, and the doctor blade will not slap if something hits the doctor during the maintenance. At the beginning of the safety tube there is an open part. Thus the doctor blade can be reached, and the portable device may be put in place. A hatch may be used to close the open part (not shown). During the maintenance, the safety tube 29 is arranged to be locked on the safety cage 15. A clamp 30, for example, may be used. Like all other parts, the safety tube will stay still independently. In this way, even a single person may perform the whole maintenance of the doctor blade. Advantageously, the safety tube is made of plastic. Thus the safety tube is light, and the doctor blade will stay unharmed when it moves inside the safety tube.

Figure 4:
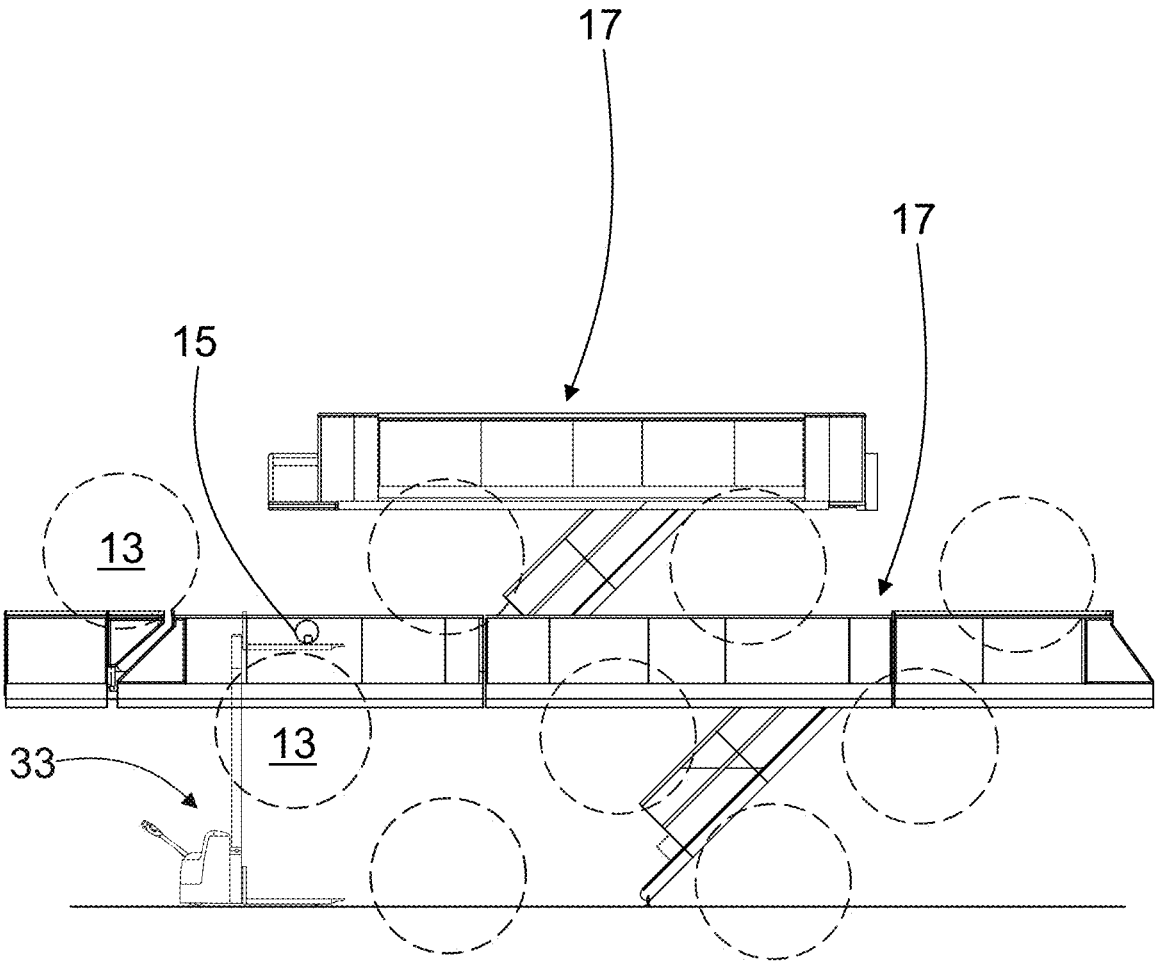
FIG. 4 shows a side view of a fiber web machine equipped with a set according to the invention.

Advantageously, the safety tube 29 includes telescopically arranged parts 31 and 32. First, it is easy to store the safety tube with one part inside another when not in use. Here, there are two parts 31 and 32, but there may be more parts also. Second, the safety tube 29 is suitable for doctor blades with different dimensions. Third, the first part of the safety tube can be rotated so that the sharp edge of the doctor blade will point to the wall of the safety tube like in FIG. 1. This increases working safety. Also, the length of the safety tube 29 is approximately the same as the doctor blade 10. This is advantageous especially when the doctor is at an upper position (FIG. 4). Then the removed doctor blade is supported throughout without bending or hanging. This is also beneficial when installing a cleaned or new doctor blade. In addition to pulling out the doctor blade, the set according to the invention is also suitable for pushing the doctor blade into the doctor blade holder. When installing the doctor blade, the portable device is fixed to the attachment point and the end of the doctor blade is introduced between the feed rollers. Then by using the portable device, the doctor blade is pushed to the doctor blade holder.

According to the invention, the set further includes a lifting platform 33 for the safety tube 29. Thus, also the doctors at upper positions can be simply reached. In FIG. 4 there are doctors on three different levels. The lifting platform 33 operates on the machine level while the safety tube 29 is at safety cage 15 positioned right at the doctor. The lifting platform 33 is freely movable and self-powered. Here an electrical forklift is used, and the safety tube 29 is secured to the forks 34 of the forklift. Also, mobile scissor lifts or other mobile lifters are suitable.

The portable device 14 has a power intake 35 for an external power source 36. The power intake 35 provides a mechanical linkage to the feed rollers 24, such than an input rotational motion is transmitted to drive the feed rollers. Thus, the portable device is simple and small and thereby easy to handle and use. Also it is possible to support the portable device straight to the doctor blade holder. Advantageously the external power source 36 is a cordless screwdriver as shown in FIGS. 1 and 2*b*. In this way the portable device can be driven by standard tools without any need for a power supply. The screwdriver has a practical and easy speed control so that in the beginning proper function of the portable device can be ensured with lower speed. Between the power intake 35 and the screwdriver there is a flexible shaft 37. By this arrangement, the screwdriver 36 may be positioned outside the safety cage and the screwdriver may be turned into an ergonomic position. The flexible shaft may include joints, or it may be like a cable.

The doctor arrangement is used in the fiber web machine. During manufacturing, the doctor blade collects fibers and other material. As time passes, there will be agglomerates, which need to be removed. These agglomerates are removed during maintenance, i.e., the doctor blade is cleaned. The doctor blade maintenance procedure for running a fiber web machine goes as follows. As described above, the doctor blade holders and doctor blades are designed for this new way of maintenance. In practice, the doctor blade is changed in one position at a time. When working at the upper level walkway, two persons should be available. One uses the portable device and the other controls the lifting platform.

The person at the machine level can call for help if the person at the upper level faints due to the heat or something surprising happens.

Before the removal of the doctor blade, the doctor control is switched to the local-only setup. Thus the doctors cannot be controlled remotely from the control room and automatic functions do not work. Also the oscillation of the doctor is stopped. The safety tube is positioned correctly by moving the lifting platform both horizontally and vertically. The telescopic safety tube is still loose from the safety cage, but it is at the same line with the doctor blade holder (FIG. 4). Then, the doctor blade holder is opened, and it is ensured that the doctor blade is off the surface of the drying cylinder.

Next, a suitable hand tool, a manual puller for example, is used to make sure that the doctor blade can move with reasonable force. If the doctor blade is stuck in the doctor blade holder, that doctor blade is skipped, and the doctor blade in question is changed during the next machine shutdown.

The person handling the doctor blade should work on the non-sharp side of the doctor blade. In the position as in FIG. 1, the person should be on the right side of the safety tube 29. Here, the sharp edge of the doctor blade 10 points downwards to the safety tube 29. When the doctor is opened and the oscillation is stopped and the doctor blade is loosened, the portable device is installed to the end of the doctor blade holder.

Next, the safety tube is pulled in contact with the safety cage and locked to the safety cage by the clamp. After checking the setup, the screwdriver is connected to the power intake and by using the screwdriver, the doctor blade is pulled out from the doctor blade holder into the safety tube. At the machine level, the doctor blade can then be removed from the safety tube. Then the removed doctor blade can be cleaned or replaced by a new one. The cleaned doctor blade or the new one is pushed into the safety tube. If the position is at the upper level, the safety tube is released from the safety cage and the safety tube is pushed back to the inward position before lowering the lifting platform. Then the doctor blade is removed from the safety tube at the machine level and cleaned or replaced. After maintenance, the doctor blade is put inside the safety tube which is then lifted and locked to the safety cage.

Before pushing the maintained doctor blade back to the doctor blade holder, it is checked that the safety tube and the lifting platform are in the correct position. The lifting platform is adjusted if necessary. Again, it is checked that the doctor is in the open position before the maintained doctor blade is guided to the slot and thereby between the feeding rollers. The portable device can be placed on the doctor blade holder when the doctor blade is maintained. In other words, there is no need to remove the portable device. Finally, by using the screwdriver, the doctor blade is driven back into the doctor blade holder. When the doctor blade is in, the screwdriver is removed, and the safety tube is loosened from the safety cage and the portable device detached from the end of doctor blade holder. The maintained doctor is returned to the remote setup and the oscillation, if any is turned on. Then the set can be used on another doctor.

The set is easy to use, and components are simple and robust. The doctor blade can be changed securely without risks for injuries. In other words, with the set, the doctor blade can be removed and installed back into the doctor blade holder, without touching the blade by hand, when the fiber web machine is in production. If needed, the lifting platform can be used elsewhere between the maintenance sessions.

We claim:

1. A set for the maintenance of a doctor blade in a fiber web machine, in which fiber web machine a doctor blade is positioned in a doctor blade holder having an end, the set comprising:

a portable device for moving the doctor blade out from the doctor blade holder, wherein the portable device is releasably connected to the doctor blade holder and configured for engaging the doctor blade between a pair of feed rollers which rotate about machine direction axes to move the doctor blade into and out from the doctor blade holder, wherein the portable device is separable from the doctor blade extension; and a prolonged doctor blade holder and a safety cage positionable in the area of the end of the doctor blade holder.

2. The set of claim 1 wherein the safety cage is separate from the doctor blade holder and arranged to be fixed in the area of a safety fence.

3. The set of claim 1 wherein the outer end of the prolonged doctor blade holder is formed of an extension piece.

4. The set of claim 3 wherein the outer end of the extension piece includes an attachment point for the portable device.

5. The set of claim 1 further comprising a safety tube for surrounding the doctor blade external from the doctor blade holder.

6. The set of claim 5 wherein the safety tube is arranged to be locked on the safety cage during the maintenance.

7. The set of claim 5 wherein the safety tube comprises telescopically arranged parts.

8. The set of claim 5 wherein the safety tube is approximately as long as the doctor blade.

9. The set of claim 5 further comprising a lifting platform for the safety tube.

10. The set of claim 9 wherein the lifting platform is freely movable and self-powered.

11. The set of claim 1 wherein the portable device has a power intake for an external power source.

12. The set of claim 1 wherein the doctor blade has an outer portion connected with a narrowing to a remainder of the doctor blade.

13. The set of claim 1 wherein the prolonged doctor blade holder and the safety cage together define a safety distance of at least 500 mm.

14. A doctor arrangement in a fiber web machine, comprising:

a doctor blade holder extending in a cross-machine direction;

a doctor blade received within the doctor blade holder and positioned to engage a roll;

a doctor blade extension which extends in the cross-machine direction beyond the roll;

a portable device releasably connected to the doctor blade extension and configured for engaging the doctor blade between a pair of feed rollers which rotate about machine direction axes to move the doctor blade into and out from the doctor blade holder, wherein the portable device is separable from the doctor blade extension; and a safety cage which surrounds the portable device and portions of the doctor blade extension and supported from a mounting point away from the doctor blade holder and the roll.

15. The arrangement of claim 14 further comprising a cordless screwdriver engaged with the portable device and operable to drive the pair of feed rollers to advance the doctor blade in the cross-machine direction.

16. The arrangement of claim 14 further comprising a safety tube positioned to receive the doctor blade as it passes out of the safety cage, the safety tube comprising a plurality of telescoping parts.

17. The arrangement of claim 16 further comprising:

a mobile lifting platform engaging a floor at a floor level below the doctor blade and having forks extending in the machine direction, wherein the safety tube extends in the cross machine direction and is secured to the forks, the lifting platform being operable to dispose the safety tube at variable heights to receive doctor blades at different heights within the fiber web machine.

* * * * *